United States Patent [19]

Peterson et al.

[11] 4,368,764

[45] Jan. 18, 1983

[54] ROTARY MULTIPLE LOG DEBARKER

[75] Inventors: Arnold N. Peterson; Dale A. Peterson, both of Pleasant Hill; Lawrence A. Sprague, Dexter, all of Oreg.

[73] Assignee: Wilber Peterson & Sons, Inc., Pleasant Hill, Oreg.

[21] Appl. No.: 339,720

[22] Filed: Jan. 15, 1982

[51] Int. Cl.[3] ..... B27L 1/00

[52] U.S. Cl. ..... 144/208 J; 144/2 Z; 241/191; 241/294

[58] Field of Search ..... 144/2 Z, 208 R, 208 J, 144/311; 241/191, 194, 294

[56] References Cited

U.S. PATENT DOCUMENTS

| | | | |
|---|---|---|---|
| 1,670,723 | 5/1928 | Hummel | 144/208 J |
| 2,436,555 | 2/1948 | Daniell | 144/208 J |
| 2,531,732 | 11/1950 | Hoffman | 241/194 |
| 2,822,837 | 2/1958 | Clausen | 144/208 J |
| 2,893,451 | 7/1959 | Dickerson | 144/208 J |
| 3,261,151 | 7/1966 | Brees et al. | 241/194 |
| 3,608,842 | 9/1971 | Engler | 241/194 |
| 4,047,549 | 9/1977 | Ratelle et al. | 144/311 X |
| 4,214,616 | 7/1980 | Brisson | 144/2 Z |

*Primary Examiner*—W. D. Bray

*Attorney, Agent, or Firm*—Klarquist, Sparkman, Campbell, Leigh, Whinston & Dellett

[57] ABSTRACT

An apparatus for scraping bark from a log includes a plurality of radially extending torsionally resistant elastomer flailing elements secured to, spaced longitudinally of, and angularly disposed around the periphery of a rotatable drum. Attached adjacent the free end of each elastomer element is a broad metallic cutting element which scrapes bark from a log. Each flexible cutting member comprised of an elastomer element and a broad cutting element attached thereto conforms to the shape of a log advancing relative to the cutting member and scrapes a substantial portion of bark therefrom.

15 Claims, 7 Drawing Figures

FIG. 1
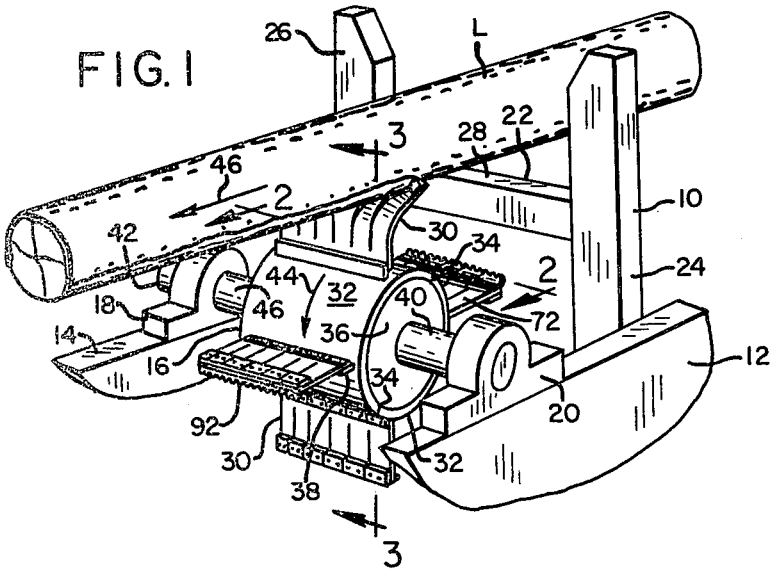
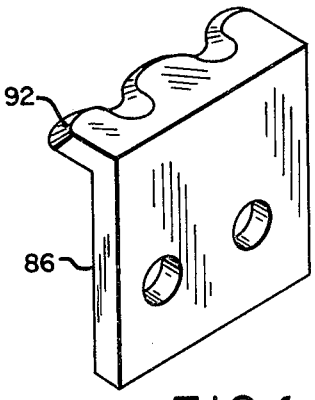
FIG. 4
FIG. 3
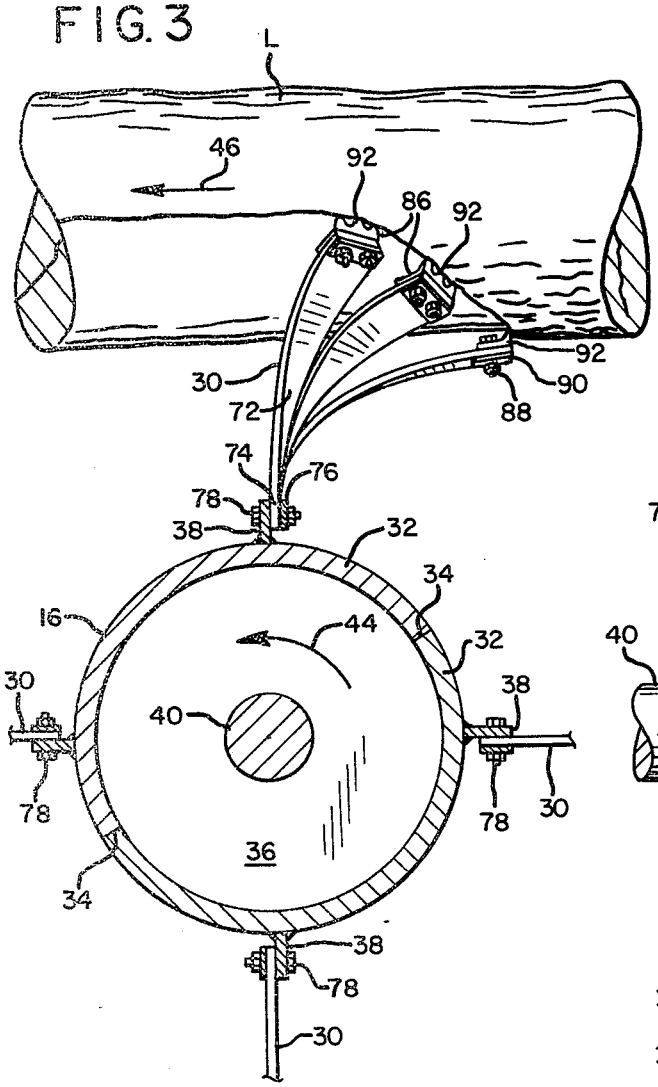
FIG. 2
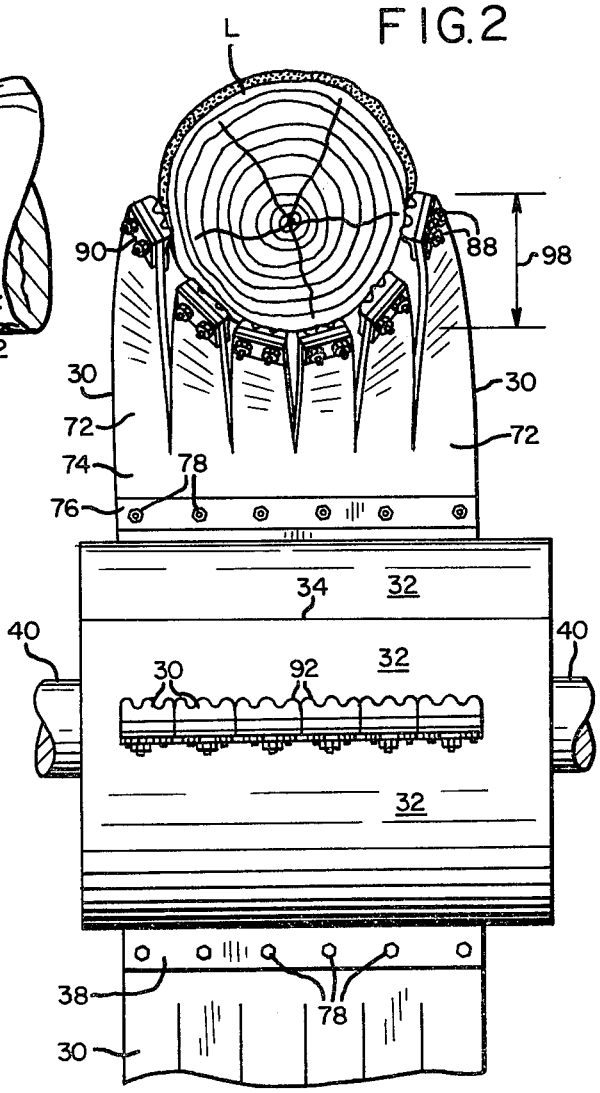

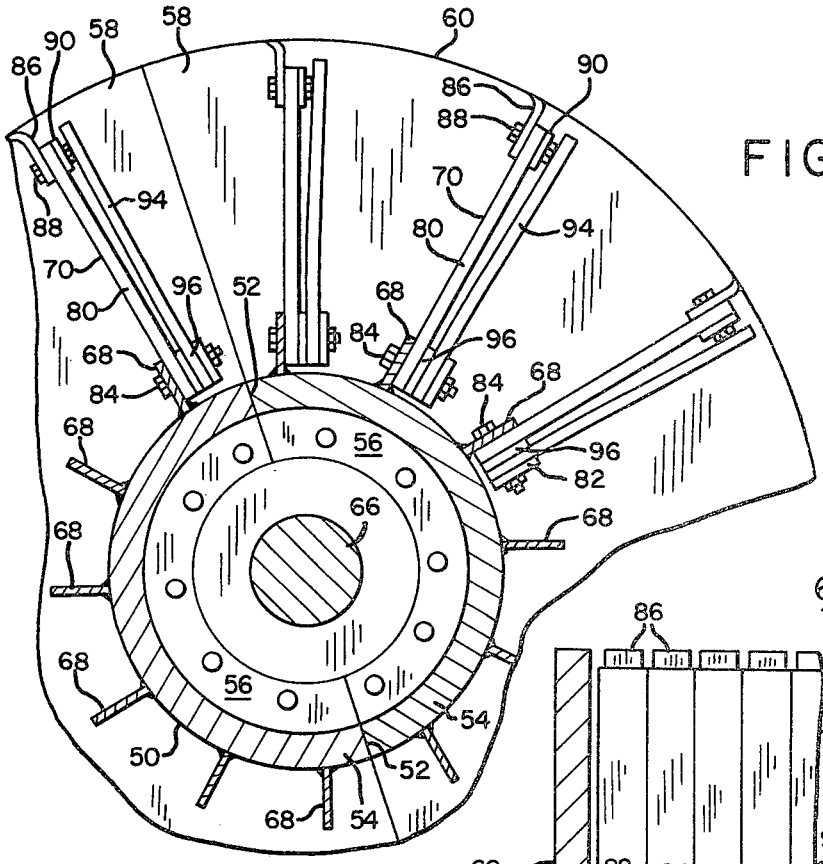
FIG. 6
FIG. 5
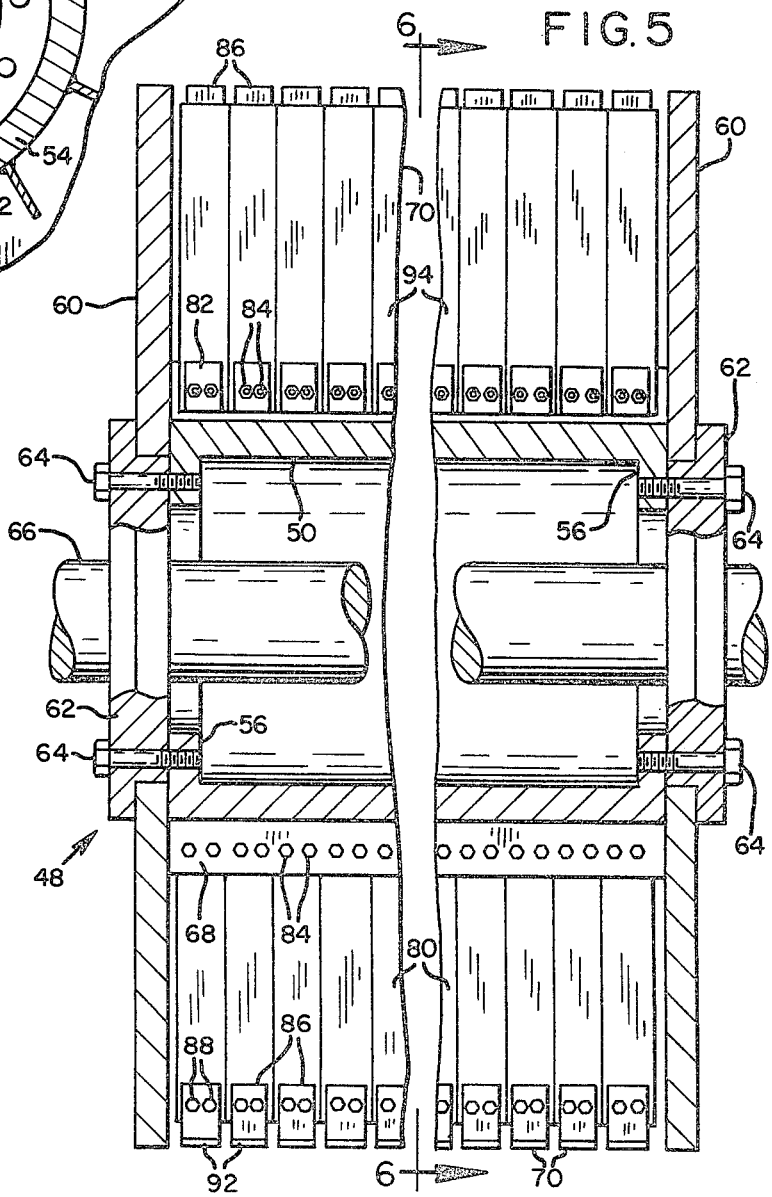
FIG. 7
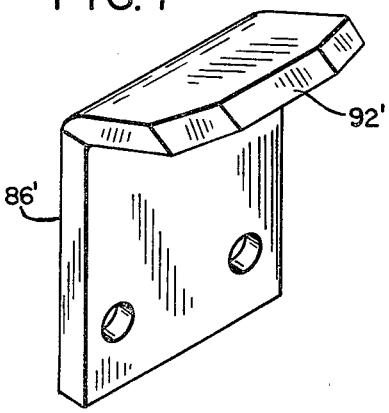

ROTARY MULTIPLE LOG DEBARKER

BACKGROUND OF THE INVENTION

1. Field of the Invention

This invention relates to means for debarking logs, and more particularly, to a rotatable debarking apparatus having torsionally resistant elastomer elements with broad cutting members mounted thereon to scrape bark from a log.

2. Description of Related Prior Art

It may be useful to review related prior art disclosures to ascertain the pertinent techniques for removing bark from a log. Two methods for flailing bark from a log are disclosed by Dickerson U.S. Pat. No. 2,893,451 and Hummel U.S. Pat. No. 1,670,723. Dickerson shows a debarker comprising a plurality of shafts spaced equidistantly from a common axis of rotation and having flexible chains pivotally mounted to each shaft. Attached to each chain link are bosses which flail bark from a log as it passes thereunder.

Hummel discloses a debarker substantially identical with the Dickerson invention with the exception that the former mechanism substitutes a spherical weight attached to the free end of each chain for the bosses found on the chain links in the latter design. Because both the Dickerson and the Hummel inventions use chains which are free to scatter in a plurality of directions after impact with a log, neither apparatus is capable of guiding or applying its cutting members to a broad area of the bark-carrying surface for a controlled and more efficient debarking operation. In addition, the tendency of closely situated chains to tangle further reduces their effectiveness and efficiency.

Clausen U.S. Pat. No. 2,822,837 shows an apparatus that peels bark from a log by advancing over the bark-carrying surface a plurality of U-shaped bristles of stiff cable rigidly secured to a rotatable drum. To achieve adequate coverage of the bark-carrying surface of the log, the Clausen invention requires a large number of debarking cycles consisting of multiple rotations and passes down the length of the log or many duplicate copies of the disclosed apparatus spaced around the periphery or along the length of the log. The reason is that the area of coverage is limited to a narrow swath during a given pass over the log to restrict the cutting depth of the stiff wires to prevent removing lumber along with the bark.

A technique disclosing a method for pounding bark from a log is shown in Daniell U.S. Pat. No. 2,436,555. This invention uses a plurality of shafts equidistantly spaced from a common axis of rotation, to which shafts rigid hammers are pivotally mounted. The hammers pass over the log and successively pound the bark-carrying surface to loosen and remove the bark. This invention suffers from the same disadvantages as those found in Clausen in that the surface area to be debarked is restricted approximately to the area of the hammer member that contacts the bark-carrying surface of the log.

None of the references discussed hereinabove discloses a debarker having a capability for engaging and scraping a substantial portion of bark in a given pass over the bark-carrying surface of a log. A primary object of this invention is, therefore, to accomplish this task by providing a debarker featuring radial members comprising torsionally resistant elements having attached adjacent the outer ends thereof broad cutting elements. The radial members have both sufficient resilience and torsional resistance such that the cutting elements can conform to the bark-carrying surface of the log. The cutting elements themselves are of sufficient width so that they engage and scrape a substantial portion of the log surface as the log advances relative to the cutting members.

An important object of this invention is to provide a debarker with means for increasing the resilience and torsional resistance of the cutting members to damp the recoil and restrict the lateral movement after impact with the log to protect other closely situated cutting members.

Another important object of this invention is to provide a debarker capable of simultaneously debarking several logs of varying sizes.

SUMMARY OF THE INVENTION

This invention responds to the deficiences presented in the references reviewed hereinabove by providing a debarking apparatus capable of aligning broad cutting members with the bark-carrying surface of a log and scraping a substantial portion of bark therefrom.

The invention comprises a drum rotatable about its longitudinal axis having a plurality of torsionally resistant elements secured to, spaced longitudinally of, and angularly disposed around the drum. Each element, which is preferably an elastomer element, is positioned to extend radially under the influence of centrifugal force and has attached adjacent its outer end a cutting element. (Hereinafter the combination of the elastomer element and the cutting element attached thereto is referred to as a flexible cutting member.).

Each cutting element, which is preferably of sufficient breadth to span the width of the elastomer element, comprises either a serrated cutting edge having a plurality of cutting teeth or multiple angularly related cutting edges that engage and strip bark from the log.

The log is positioned with its longitudinal axis spaced from and extending across the axis of the drum. The log and drum move relative to each other to advance the flexible cutting members across the bark-carrying surface. This is accomplished by either advancing the log across the drum or moving the drum along the length of a stationary log.

As the log advances toward and encounters the flexible cutting members extending from the rotating drum, the elastomer elements deflect from their radial disposition. The elastomer elements experience a torsional force as the cutting elements attached adjacent the outer ends thereof engage the bark-carrying surface and orient themselves to conform to the shape of the log.

It is the resilience property of the elastomer that urges the cutting element against the surface of the log and the torsional resistance thereof which permits the cutting element to fit squarely against the bark-carrying surface. The broad cutting edge of the cutting element than can engage and scrape a substantial portion of bark from the log. A plurality of flexible cutting members spaced longitudinally along the axis of the drum provide conformal coverage over a substantial portion of the surface of the log.

The invention further contemplates the provision of means to protect each flexible cutting member from the interference resulting from the recoil or torsional lateral movement of a closely situated flexible cutting member after impact with the bark-carrying surface of the log.

Such is accomplished by placing another elastomer element adjacent a side of the flexible cutting member. This protective element also serves to promote the return of the flexible cutting member to a radial disposition after impact with the log by stiffening the elastomer element to which it is attached, thereby further increasing the resilience and torsional resistance of the flexible cutting member.

The foregoing and other objects, features and advantages of the present invention will become more apparent from the following detailed description which proceeds with reference to the accompanying drawings.

BRIEF DESCRIPTION OF THE DRAWINGS

In the drawings:

FIG. 1 is an isometric view of a first embodiment of the present invention shown partly in section and in operative use;

FIG. 2 is a vertial sectional view taken along the line 2—2 of FIG. 1 showing the conformal coverage of the flexible cutting members upon the bark carrying surface of a log;

FIG. 3 is a vertical sectional view taken along the line 3—3 of FIG. 1 showing the relationship of the direction of log travel to the direction of both the drum rotation and angular disposition of the cutting elements during the debarking operation;

FIG. 4 is an isometric view of a cutting element in accordance with the invention;

FIG. 5 is a cross-sectional view of a portion of an alternative embodiment of the apparatus showing a different means for attaching individual elastomer elements to the periphery of the drum;

FIG. 6 is a vertical sectional view taken along the line 6—6 of FIG. 5 showing the backing means for protecting the flexible cutting members.

FIG. 7 is an isometric view of an alternative embodiment of a cutting element in accordance with the invention.

DETAILED DESCRIPTION

Structure of the Drum and Support Apparatus

General Description and Support Structure

FIGS. 1–3 illustrate a first embodiment of the invention which is used primarily for debarking small timber. As shown in FIG. 1, a support structure 10 is comprised in part of side members 12 and 14 which are spaced at a distance sufficient to accommodate a length of a drum 16 rotatably mounted therebetween through bearings 18 and 20. Positioned medially of side members 12 and 14 are at least two sets (only one of which is shown) of H-shaped frames 22 each having two vertically disposed standards 24 and 26 joined by a crossbar 28 that supports a log L resting thereon. Crossbar 28 is preferably adjustable and positioned at height to provide sufficient clearance for flexible cutting members 30 which extend radially under centrifugal force from the periphery of drum 16 to engage the surface of log L and scrape bark therefrom.

Drum

The drum 16 is formed by welding together the longitudinal sides of a pair of identical semicylindrical shells 32 as at 34 in FIGS. 1–3. Two disc-shaped side plates 36 (only one of which is shown) are welded at either end of drum 16. Four radially extending longitudinal flanges 38 are welded at the quadrant points to the periphery of drum 16 to which are attached cutting members 30 as will be hereinafter further described.

A shaft 40 passes through and is welded to side plates 36. Shaft 40 is journaled in bearings 18 and 20 which serve to rotatably mount drum 16 onto support structure 10. A suitable power source (not shown) connected to the drive end 42 of shaft 40 rotates drum 16 in the direction 44 at approximately 300 rpm to accomplish the debarking of log L, which is advanced in the direction 46 by a suitable feed means (not shown). Moving flexible cutting member 30 in direction 46 of log travel at the point of impact assists the feed means in urging log L along support structure 10. Successful debarking of log L can be accomplished, however, with log L traveling in a direction opposite to that shown.

FIG. 5 and 6 illustrate a second embodiment which can be used to debark very large timber or to debark simultaneously several timber of varying sizes. A drum assembly 48 includes a drum 50 formed by welding together the longitudinal edges 52 of a pair of identical semicylindrical shells 54. Each shell 54 includes an inner flange 56 forming a semiannular end portion to which is welded a pair of semiannular end members 58 which form side plates 60 as shown. A collar member 62 is bolted to flanges 56 by bolts 64. A shaft 66 passing through and welded to collar member 62 rotatably mounts assembly 48 in a support structure similar to that described for drum 16. A plurality of radially extending longitudinal flange members 68 are welded to the periphery of drum 50 to support individual flexible cutting members 70 as shown.

The assembly 48 is generally characterized by providing support for a large number of cutting members 70, which are more closely angularly spaced than cutting members 30 in the embodiment of FIGS. 1–3. Because of the close angular spacing of flange members 68 around drum 50 in this embodiment, it is advantageous to restrict flange members 68 to a length shorter than that of drum 50. Flange members 68 may then be arranged (not shown) to abut alternately either edge of drum 50, thereby staggering flexible cutting members 70 to facilitate their removal therefrom. Side plates 60 partly enclose drum assembly 48 to confine flexible cutting members 70 and inhibit their tendency to spread laterally while engaging a log, thereby preserving conformal coverage of the bark-carrying surface. Side plates 60 also protect cutting members 70 during transportation of drum assembly 48.

Elastomer Element

In the embodiment of FIGS. 1–3, cutting members 30 comprise a plurality of elastomer elements 72 in the form of rectangular-shaped belts made from elastomer material, such as "Plylon" brand belting manufactured by Goodyear Tire & Rubber Co. Material of this type possesses torsional resistance and resilience properties which are effective to promote debarking operations in accordance with this invention. The individual flailing elements 72 are preferably formed by making a series of equally spaced, partial cuts extending perpendicular to a side of a rectangular piece of elastomer material, which side measures substantially the length of drum 16. The cuts are made to form elastomer strips of equal width and of the desired length. Each flailing element 72 shares a common base 74 with the others. The common base 74 is inserted between a single rectangular back plate 76 and flange 38 and is secured to the periphery of drum 16 by bolts 78.

In the alternative embodiment of FIGS. 5 and 6 the elastomer elements 80 are formed individually, each having its onw base. Each elastomer element 80 is inserted between a separate rectangular back plate 82 and flange 68 and is secured to the periphery of drum 50 by a pair of bolts 84.

Although the fabrication of either type of elastomer element has been described relative to a particular drum embodiment, either elastomer element 72 or 80 can be attached to either drum 16 or 50 in accordance with the procedures described hereinabove.

Broad Cutting Element

Although the following discussion is directed to the embodiment of FIGS. 1–3, the following method for attaching the broad metallic cutting element 86, shown in FIG. 4, adjacent the outer end of each elastomer element 72 applies similarly to elastomer elements 80 of FIGS. 5 and 6. The cutting element 86 spans and therefore specifies the width fo the free end of elastomer element 72 to which it is attached by bolts 88. A back plate 90 is also secured opposite the cutter-bearing face of elastomer element 72 by bolts 88 to ensure that bolts 88 are not drawn through the elastomer material as cutting element 86 engages the surface of the log. As shown in FIG. 4, each cutting element has a serrated edge 92 comprised of a plurality of cutting teeth which are disposed at a right angle measured from the inner face of cutting element 86. Each cutting element 86 is of sufficient width to engage a substantial portion of the bark-carrying surface of a log and strip bark therefrom.

FIG. 7 shows an alternative embodiment 86' of a broad metallic cutting element having a plurality of angularly related cutting edges 92'. The foregoing discussion of the configuration, dimensions, and attachment procedure for cutting element 86 applies similarly to the alternative embodiment with the pertinent features corresponding to those of cutting element 86 designated with descriptive numerals followed by primes. Cutting element 86' has a broad cutting surface with multiple, preferably three, angularly related cutting edges 92' configured to simplify a sharpening operation.

Protective Backing Means

The embodiment of FIGS. 5 and 6 shows a protective backing means 94, preferably a second element identical with elastomer element 80, positioned behind flexible cutting member 70 to dampen its recoil and lateral movement after impact with the log. The protective backing means 94 is inserted behind but separated from flexible cutting member 70 by a rectangular spacer 96, which may be a member identical with back plate 82. Flexible cutting member 70, spacer 96, and back plate 82 are secured by two bolts 84 to flange 68.

Although the foregoing description has been directed to the individual flexible cutting members 80 of FIGS. 5 and 6, the protective function can be accomplished in the embodiment of FIGS. 1–3 by inserting a second back plate 76 as a spacer between flexible cutting members 30 and a second set of elastomer elements 72 sharing common bases 74. Attachment of these three components along with back plate 76 to flange 38 is performed in a manner similar to that described hereinabove.

Operation

With reference to FIGS. 1–3, the debarking operation is accomplished by using a suitable feed means (not shown) for advancing log L over drum 16 in direction 46 which is the same as direction of rotation 44 at the point of impact. Flexible cutting members 30 extend radially upon rotation of drum 16 and scrape bark from log L. Cutting elements 86 are positioned adjacent the free ends of elastomer elements 72 and are bent in the direction of rotation 44 of drum 16, thus presenting broad serrated edges 92 to the advancing log L.

As log L approaches drum 16 rotating at approximately 300 rpm, flexible cutting members 30 encouter and conform to the bark-carrying surface of log L as shown in FIGS. 2 and 3. The successive impact of flexible cutting members 30 against the surface of log L loosens the bark, whereby the teeth of serrated edges 92 of broad cutting elements 86 scrape and remove substantial portions of bark.

The clearance of log L above the surface of drum 16 can be adjusted by raising or lowering crossbar 28 to optimize the reach of flexible cutting members 30 to the surface of log L. The resilience and torsional resistance properties of elastomer elements 30 promote the conformal coverage of flexible cutting members 30 around the surface of log L. Optimally, coordinating the clearance height with the radius of log L facilitates the removal of a substantial portion of bark during one pass in a debarking operation as shown by dimension 98 in FIG. 2.

The resilience and torsional resistance of elastomer element 72, preferably enhanced by attaching an elastomer stiffener such as protective backing means 94 incorporated in the alternative embodiment of FIGS. 5 and 6, promotes the radial dispostion of flexible cutting members 30 in anticipation of their next encounter with log L during each successive revolution of drum 16. The elastomer stiffener serves also to protect flexible cutting member 30 from damage by restricting its recoil and lateral movement as well as that of adjacent flexible cutting members 30.

It is possible to debark a log or several logs simultaneously in one pass along a support structure if three debarkers of the type disclosed in this application are separated along the length of a support structure and angularly spaced about the log or logs which are elevated to an optimum clearance height for maximum surface coverage.

A more preferable construction is four debarkers spaced at quadrant points about a support structure such as that shown in FIG. 1. This arrangement accomplishes sufficient redundancy of coverage over the surface of the logs so that a particular clearance height can be established to allow complete simultaneous debarking of logs of extensively varying sizes.

The debarking operations described hereinabove may be accomplished also by moving the drum assemblies mounted on a suitably adapted support apparatus along the lengths of stationary logs.

The embodiment of FIGS. 5 and 6 is readily adaptable for use as a portable device for on-site debarking operations. For example, drum assembly 48 can be rotatably mounted on a structure connected to the rear of a flat bed carrier equipped with the appropriate means to load the logs on the bed. The debarking operation can be accomplished as the log passes over the rotating drum assembly 48 powered by an external drive means.

Having illustrated and described what are presently two preferred embodiments of our invention, it should be apparent to those skilled in the art that the two embodiments may be modified in arrangement and detail without departing from the principles of the invention which are intended to be illustrated but not limited by the disclosure. We therefore claim as our invention all such modifications as come within the true spirit and scope of the following claims.

What is claimed is:

1. In an apparatus for debarking a log,
a drum;
means to rotate the drum about its longitudinal axis;
means to position the log with its longitudinal axis spaced from and extending across the axis of the drum;
a torsionally resistant self-supporting element secured to the drum to project radially therefrom, the element comprising resilient longitudinally flexible material; and
a cutter secured adjacent the outer end of the torsionally resistant element to impact the bark-carrying surface of the log and scrape bark therefrom, the torsionally resistant element being adapted continuously to align the cutter to a position conforming to and substantially fully in contact with the bark-carrying surface of the log.

2. Apparatus as in claim 1 further comprising means to damp the recoil and to restrict the lateral movement of the torsionally resistant element caused by impact with the log.

3. Apparatus as in claim 1 wherein the torsionally resistant element comprises an elastomer element.

4. Apparatus as in claim 3 further comprising a plurality of elastomer elements angularly spaced around the drum.

5. In an apparatus for debarking a log,
a drum;
means to rotate the drum;
a plurality of torsionally resistant elastomer elements secured to and spaced longitudinally of the drum and positioned to extend radially under centrifugal force;
a broad metallic cutting element attached to the outer end of each of the elastomer elements; and
means to move the elastomer elements bearing the cutting elements and the bark-carrying surface of the log relative to each other to advance the elastomer elements along the bark-carrying surface.

6. Apparatus as in claim 5 wherein the elastomer elements are angularly spaced around the drum.

7. Apparatus as in claim 5 further comprising means to damp the recoil and to restrict the torsional lateral movement of the elastomer elements caused by impact with the log to prevent interference with one another.

8. Apparatus as in claim 7 wherein the damping and restricting means comprises another elastomer element positioned adjacent a face of the elastomer element.

9. Apparatus as in claim 7 wherein the damping and restricting means comprises another elastomer element positioned adjacent a face of the elastomer element not bearing the cutting element.

10. In an apparatus for debarking a log
a drum;
means to rotate the drum;
a torsionally resistant elastomer element secured to the drum and positioned to extend radially under centrifugal force;
a cutting element having a broad cutting edge attached adjacent the outer end of the elastomer element so that upon rotation of the drum the cutting edge of the cutting element aligns with and impacts the bark-carrying surface of the log to scrape bark therefrom; and
means to move the elastomer element bearing the cutting element and the bark-carrying surface of the log relative to each other to advance the elastomer element along the bark-carrying surface.

11. Apparatus as in claim 10 wherein the cutting element comprises a serrated cutting edge angularly disposed relative to the cutter element-bearing surface of the elastomer element.

12. Apparatus as in claim 10 wherein the cutting element comprises a plurality of angularly related cutting edges.

13. A flexible cutting member for a debarker having a rotatable drum spaced from a log being debarked, the flexible cutting member including a torsionally resistant self-supporting element comprising resilient longitudinally flexible material and a cutter secured to the torsionally resistant element adjacent an end thereof, the other end of the torsionally resistant element being adapted to mount on the drum with the cutter extending radially therefrom, the torsionally resistant element being adapted continuously to align the cutter to a position conforming to and substantially fully in contact with the bark-carrying surface of the log, thereby to cause the cutter to impact and engage the surface of the log to scrape bark therefrom.

14. A flexible cutting member as in claim 13 wherein the cutter comprises a broad member having a cutting edge.

15. A flexible cutting member as in claim 13 wherein the torsionally resistant element comprises a torsionally resistant elastomer element.

* * * * *